US008281428B1

(12) United States Patent
Shrewsbury

(10) Patent No.: US 8,281,428 B1
(45) Date of Patent: Oct. 9, 2012

(54) DISABILITY SHOWER

(76) Inventor: William R. Shrewsbury, Overland Park, KS (US)

( * ) Notice: Subject to any disclaimer, the term of this patent is extended or adjusted under 35 U.S.C. 154(b) by 572 days.

(21) Appl. No.: 12/609,471

(22) Filed: Oct. 30, 2009

(51) Int. Cl.
*A47K 3/022* (2006.01)
*A47K 3/28* (2006.01)

(52) U.S. Cl. ..... 4/604; 4/578.1

(58) Field of Classification Search ..... 4/604, 579, 4/578.1, 573.1, 571.1, 564.1
See application file for complete search history.

(56) References Cited

U.S. PATENT DOCUMENTS

| | | | | |
|---|---|---|---|---|
| 3,040,335 | A | 6/1962 | Gellmann | |
| 3,082,432 | A | 3/1963 | Pearlman | |
| 3,528,112 | A | 9/1970 | Warnick | |
| 3,711,872 | A | 1/1973 | Jarosinski | |
| 3,900,902 | A | 8/1975 | Jarosinski | |
| 4,123,808 | A | 11/1978 | Guarrera | |
| 4,150,445 | A * | 4/1979 | Bailey | 4/546 |
| 4,254,517 | A * | 3/1981 | Herman, Jr. | 4/564.1 |
| 5,682,626 | A * | 11/1997 | Banks et al. | 4/541.5 |
| 6,859,954 | B2 * | 3/2005 | Collins et al. | 4/541.1 |
| RE38,841 | E | 10/2005 | Yoshida et al. | |
| 2007/0226895 | A1 | 10/2007 | Sato et al. | |
| 2008/0313799 | A1 | 12/2008 | Nguyen | |

FOREIGN PATENT DOCUMENTS

| | | |
|---|---|---|
| GB | 2240712 | 8/1991 |
| JP | 4005929 | 1/1992 |
| JP | 4332556 | 11/1992 |
| JP | 6125965 | 5/1994 |
| JP | 6284985 | 10/1994 |
| JP | 8280565 | 10/1996 |
| JP | 2003325370 | 11/2003 |

* cited by examiner

*Primary Examiner* — Huyen Le
(74) *Attorney, Agent, or Firm* — Erickson, Kernell, Derusseau & Kleypas, LLC

(57) ABSTRACT

A shower unit includes a shower seat having a plurality of moveable seat pads. Each seat pad is moveable between an extended position wherein the pad is in contact with the body of a user sitting on the seat and a retracted position wherein the pad is spaced away from the user's body. When a pad is in the retracted position, the body surface that would normally be occluded by the pad becomes accessible to spray from a nozzle so that the body surface can be cleaned. While any one pad is in the retracted position, the user is supported on enough of the other seat pads to remain in a stable sitting position. The spray nozzles may be mounted in the seat pads themselves, or may be mounted in the shower seat proximate to the pads.

19 Claims, 8 Drawing Sheets

DISABILITY SHOWER

BACKGROUND OF THE INVENTION

1. Field of the Invention

The present invention relates to the field of bathing apparatuses for disabled persons, and in particular to a disability shower which allows a disabled person to shower in a seated position while cleaning all body surfaces including those body surfaces normally inaccessible when seated.

2. Description of the Related Art

Taking a shower is a regular, daily activity for most people. For those who are disabled, elderly or otherwise physically challenged, including disabled veterans, however, standing for a shower can be difficult or impossible. Taking a shower while seated, such as by using a simple shower chair, can be problematic because the body surfaces upon which the person is seated, such as the buttocks and backs of the thighs, are obscured by the chair and made difficult to clean. This situation is especially difficult for the more seriously disabled who are unable to shower themselves and must be bathed by an assistant. Manipulating the disabled person on a shower chair to clean all body surfaces can be physically demanding for the assistant and hazardous for the disabled person who is subject to fall or topple over during the process.

What is needed is a shower system which allows a person to shower while in a seated position, but which provides a mechanism for exposing all body surfaces, including those body surfaces which are normally obscured while sitting. Preferably, the system would also allow the user to be showered automatically with minimal input from the user or from an assistant.

SUMMARY OF THE INVENTION

The present invention is a shower unit having a shower seat comprised of moveable seat pads. Each seat pad is moveable between an extended position wherein the pad is in contact with the body of a user sitting on the seat and a retracted position wherein the pad is spaced away from the user's body. When a pad is in the retracted position, the body surface that would normally be occluded by the pad becomes accessible to spray from a nozzle so that the body surface can be cleaned. While any one pad is in the retracted position, the user is supported on enough of the other seat pads to remain in a stable sitting position. Additional support for the user is provided by grab bars on opposed sides of the shower seat and torso supports positioned to catch the user if he or she begins to topple sideways. A front safety bar which swings in front of the user can also be used for severely disabled users.

The spray nozzles used to wash the body surfaces exposed by retraction of the seat pads may be mounted in the seat pads themselves, or may be mounted in the shower seat proximate to the pads. If the nozzles are mounted in the seat pads, they can be controlled to spray only when the pads move out of the extended position so that there is clearance between the nozzles and the body surface.

The shower unit is preferably automatically controlled to move the seat pads and turn the spray nozzles off and on at the correct times. Onboard supplies of soap or body wash are provided to be mixed with water for a wash cycle which is followed by a rinse. The shower unit also includes an array of shampoo nozzles directed at the top of the user's head (which may be mounted in a shampoo cap) and other spray nozzles strategically located to provide full body cleansing.

DETAILED DESCRIPTION OF THE PREFERRED EMBODIMENTS

Figure 1:
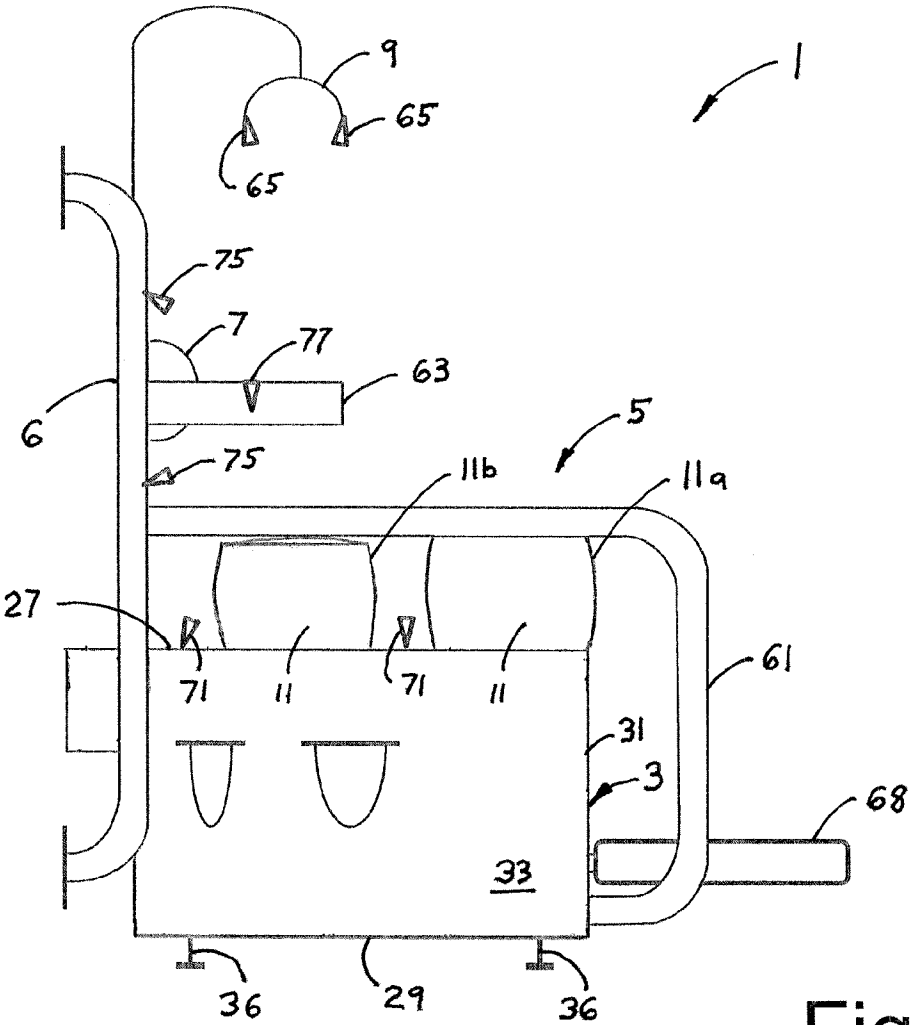
FIG. 1 is a side elevational view of a shower unit according to the present invention.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Figure 2:
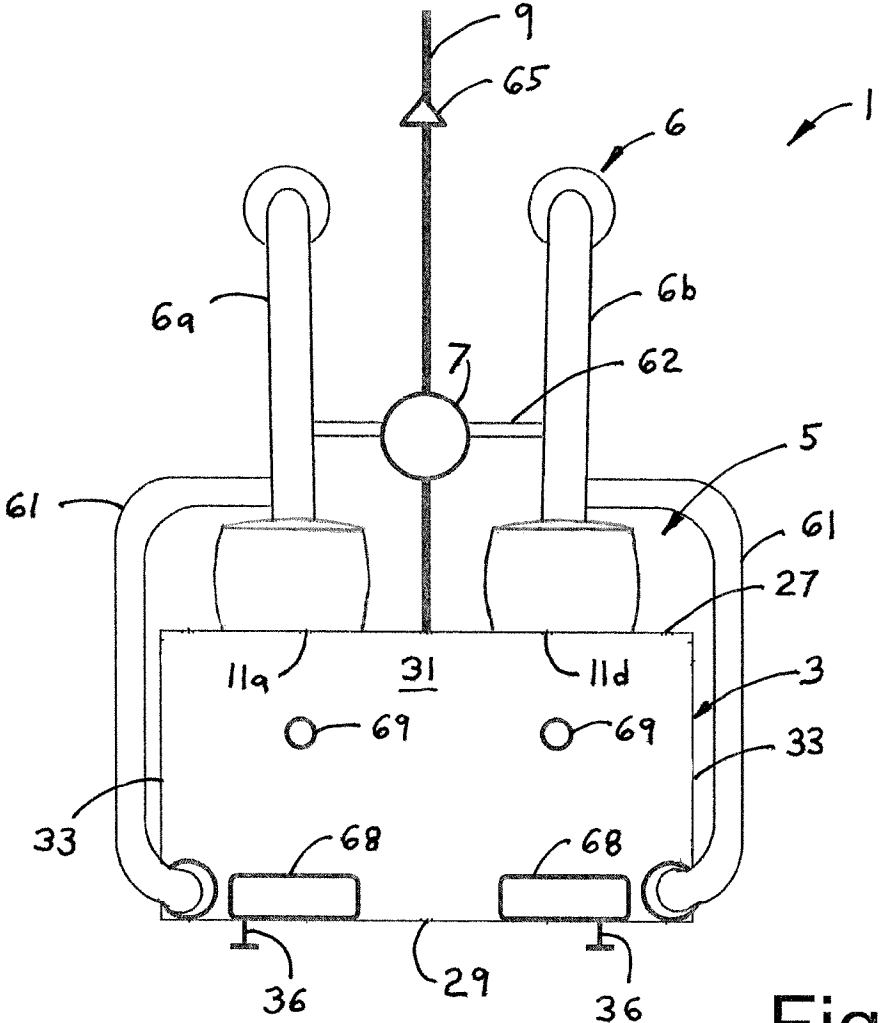
FIG. 2 is a front elevational view of the shower unit.
Figure 3:
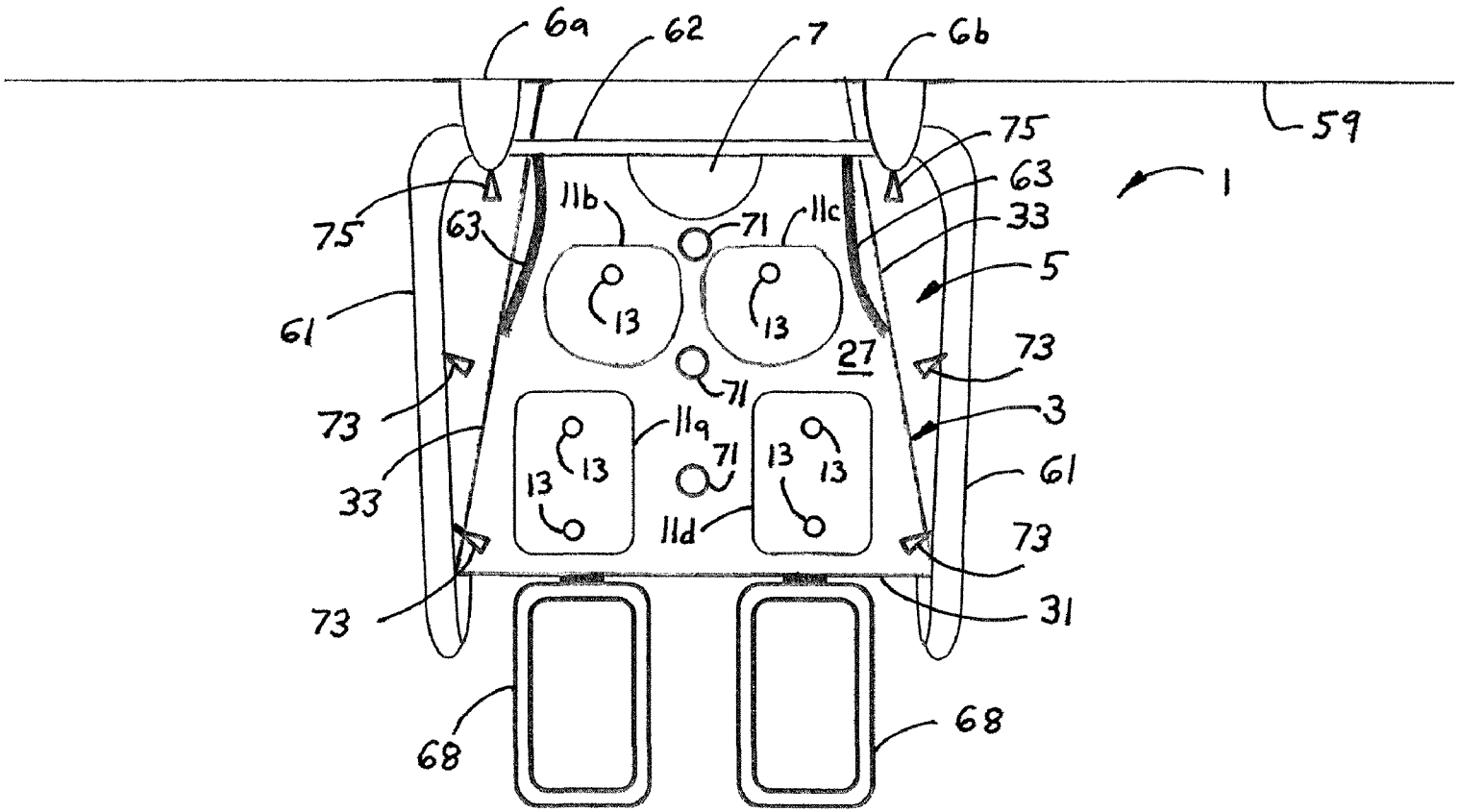
FIG. 3 is a top plan view of the shower unit.

Referring to the drawings in more detail, and in particular to FIGS. 1-3, the reference number 1 generally designates a disability shower unit according to the present invention. The unit 1 includes a base 3, a shower seat 5 mounted on an upper surface of the base 3 and a generally vertical back support 6. The back support 6 may extend upwardly from the base 3 proximate the back side thereof, and/or may be secured to a wall adjacent to the base 3. A backrest 7 is adjustably mounted on the back support 6 and a shampoo array or cap 9 is mounted to the back support 6 above the backrest 7.

The shower seat 5 includes a plurality of moveable seat pads 11. Four pads 11*a*-11*d* are shown in the accompanying drawings, however it is to be understood that more or less than four pads 11 could be used. For example, the unit 1 may be customized for an individual user by adding extra pads 11 for a taller user or by removing pads 11 for a user who is an amputee. Each of the pads 11 is independently moveable toward and away from a user seated on the shower seat 5 between an extended position and a retracted position. In the extended position of each of the pads 11, the respective pad 11 acts in combination with at least some of the other pads 11 to support the user. In the retracted position, the respective pad 11 is spaced away from the user who is then supported by the pads 11 which remain in the extended position. For example, when pad 11*a* is in the extended position it acts in combination with at least some of the pads 11*b*-11*d* to support the user. When the pad 11*a* is in the retracted position, the user is supported by pads 11*b*-11*d*.

When any given one of the pads 11 is in the retracted position, the body surface of the user which would normally rest on that pad 11 becomes exposed and can be washed. Washing is accomplished by spraying the body surface with a soap and water mixture from one or more spray nozzles 13 directed toward the body surface and later rinsing the body surface with a spray of rinse water. The nozzles 13 may be mounted in the pads 11 or may be mounted in the seat 5 external of the pads 11.

FIG. 3 shows an embodiment of the shower unit 1 having at least one nozzle 13 mounted in each of the pads 11. Each pad 11 includes one or more spray nozzles 13 which are positioned to direct a spray from the upper surface of the pad 11. Each nozzle 13 is connected to a water source 15 and to a source of liquid soap or body wash 16 (shown schematically in FIG. 6). When a selected pad 11 is in the extended position, the respective nozzles 13 are turned off. As the pad 11 moves away from the user, the respective nozzles 13 spray either soapy water or rinse water toward the user. The nozzles 13 are turned off before the pad 11 begins to move back toward the user.

Figure 4:
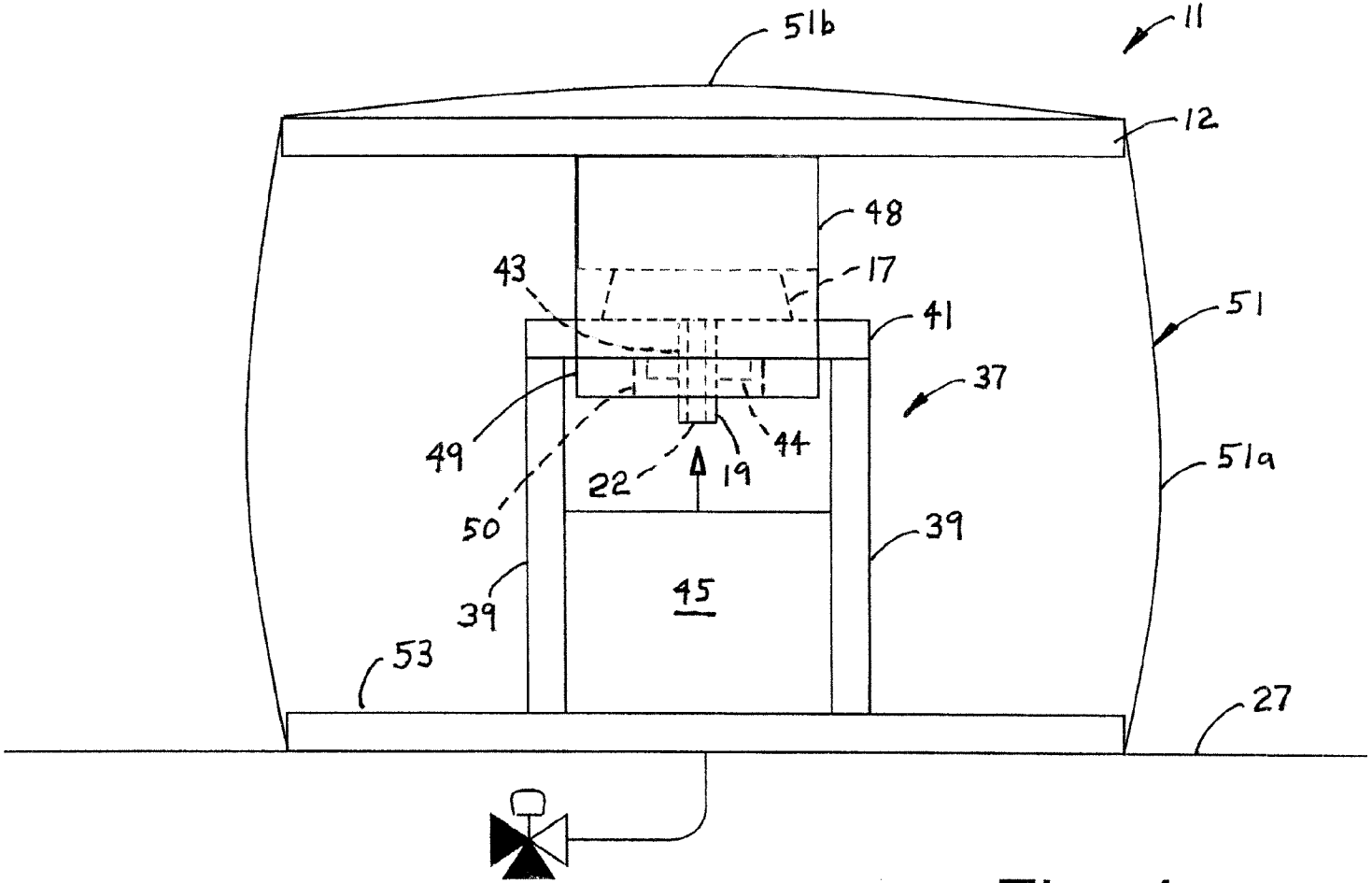
FIG. 4 is a front elevational view of a seat pad which forms a part of the shower unit. For clarity, a cover which encloses the seat pad has been made transparent.
Figure 5:
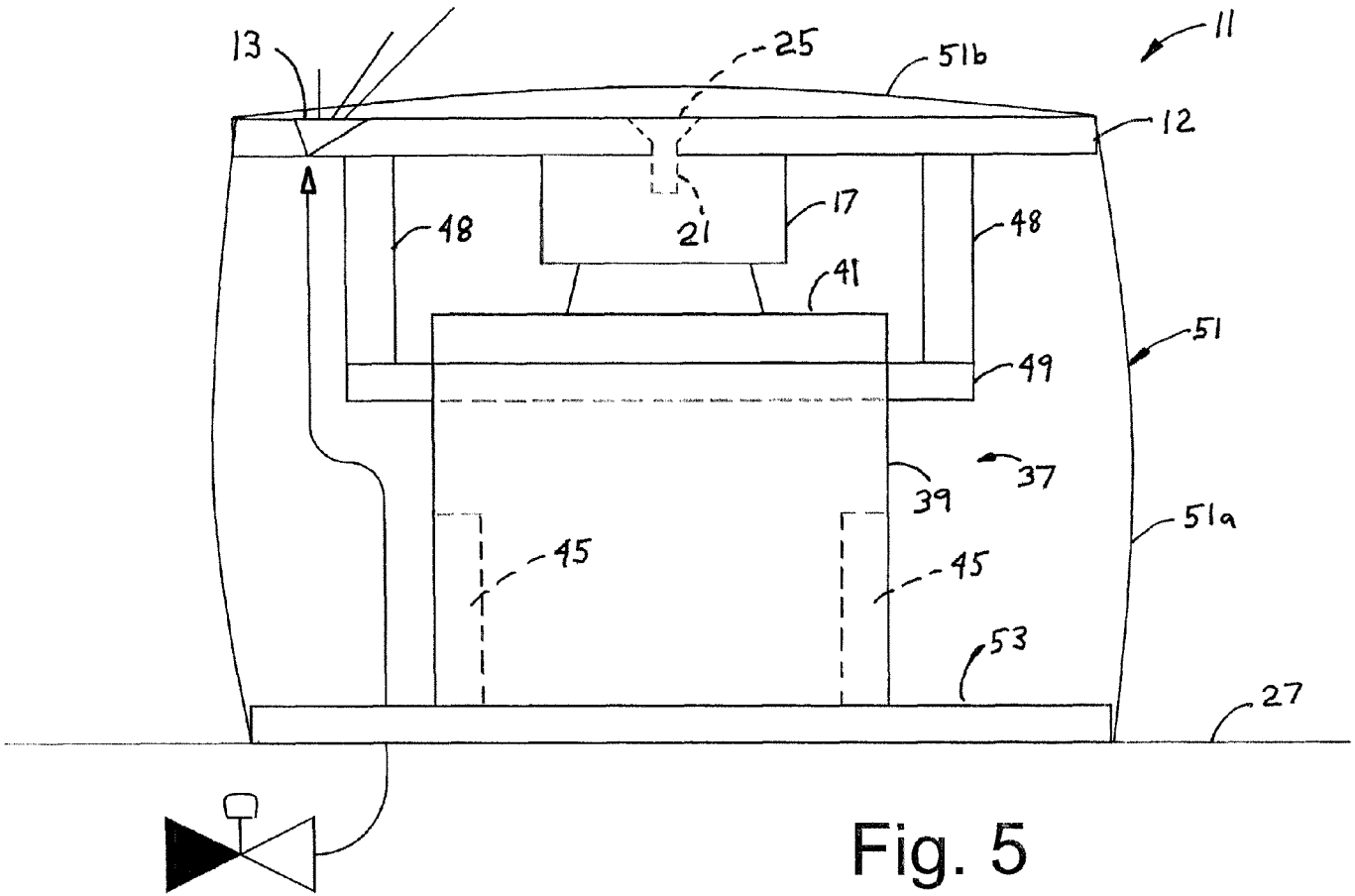
FIG. 5 is a side elevational view of the seat pad of FIG. 4.

Referring to FIGS. 4 and 5, the pads 11 are moved by respective linear actuators 17 and are controlled to move in a cyclical manner. Preferred actuators 17 are pneumatic air bags, such as Firestone® Airstroke® 1M1A-0 actuators. This actuator 17 includes a mounting stud 19 on its lower end and a bolt receiver 21 in its upper surface. The mounting stud 19 includes an internal passageway 22 which serves as the air inlet for the actuator 17. Each pad 11 moves through a stroke of approximately 25-32 mm.

Each pad 11 includes a pad plate 12 which is secured to the top of the respective actuator 17 by a bolt 25 received in the respective bolt receiver 21. The pad plates 12 (and, therefore, pads 11) are each shaped according to their position on the seat 5 and are preferably custom shaped to fit an individual user. It is foreseen that the rear pads 11*b* and 11*c*, which are shaped to support the buttocks of the user, will generally remain the same for all users, whereas the size of the front pads 11*a* and 11*d*, which support the thighs of the user, will be custom tailored to each individual user. For example, the front pads 11*a* and 11*d* may be available in standard, small, medium and large sizes. It has also been found that for optimum balance, the front pads 11*a* and 11*d* should be spaced somewhat higher than the rear pads 11*b* and 11*c* when the pads 11 are in the extended position, for example 10-15 mm higher.

While pneumatic air bag actuators are the preferred actuators 17 for moving the pads 11, it is foreseen that other types of actuators, including hydraulic actuators and other types of pneumatic actuators may be used. It is foreseen that hydraulic actuators may be operated by water pressure.

Referring again to FIGS. 1-3, the base 3 may, for example, include a top plate 27, bottom plate 29, front plate 31, and a pair of side plates 33 connected along their edges to form a box-like structure defining an interior cavity. The base 3 sits on adjustable feet 36 connected to the bottom plate 29.

Referring again to FIGS. 4 and 5, the actuators 17 are each mounted on the top plate 27 by respective actuator mounting assemblies 37. Each actuator mounting assembly 37 includes a pair of legs 39 which extend upwardly from the top plate 27 and a cross piece 41 which is connected across the tops of the legs 39. Each cross piece 41 includes a center hole 43 for receiving the stud 19 of the respective actuator 17. A nut 44 is received on the stud 19 of each actuator 17 to secure the actuator 17 to the respective cross piece 41. A pair of stops 45 are mounted between the legs 39 to limit the downward movement of the respective pad 11. Attached to each pad plate 12 are a pair of side plates 48 which extend downwardly therefrom on opposite sides of the respective cross piece 41. A keeper plate 49 connects the side plates 48 below the respective cross piece 41 and thereby limits upward movement of the respective pad 11. The keeper plate 49 includes an opening 50 which provides access to the air passageway 22 and allows connection of an air line thereto.

The pads 11 may be enclosed by a cover 51 formed of a flexible waterproof material, such as rubber, or may be left uncovered. If a cover 51 is used, there may be a respective cover 51 for each of the pads 11, or multiple pads 11 may be covered by the same cover 51. For example, left and right pairs of the pads 11 could each share a cover 51, or a single cover 51 could be used to cover all of the pads 11. In the embodiment shown, each pad 11 is covered by a respective cover 51 which is formed in two pieces 51*a* and 51*b*. Cover section 51*a* is formed as a sleeve and slid around the assembly covering the sides. An annular flange 53 extending upward from the top plate 27 mounts the lower end of cover section 51*a*. Cover section 51*b* is a separate cover for the top of the pad 11. Cover sections 51*a* and 51*b* are held in position with compression rings (not shown) encircling the pad plate 12 and the annular flange 53.

Figure 6:
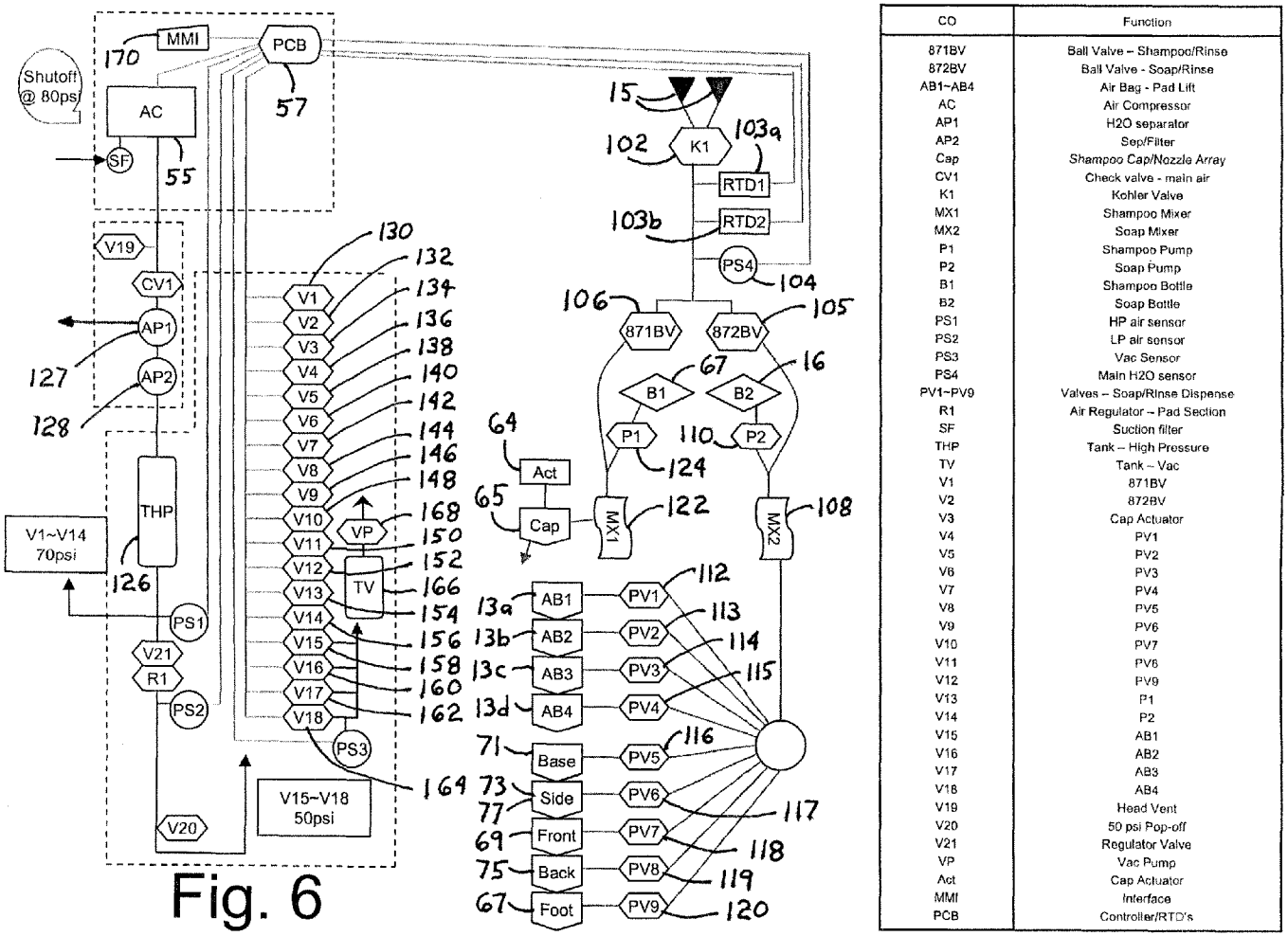
FIG. 6 is a schematic diagram of pneumatic and plumbing circuits of the shower unit.

As shown schematically in FIG. 6, the actuators 17 connected to the pads 11 are powered by an air compressor 55 acting through appropriate valving controlled by an electronic controller 57. Positive pressure is applied to the actuators 17 in order to cause them to extend and vacuum is applied to the actuators 17 in order to make them retract.

As shown in FIG. 2, the back support 6 may be formed of two parallel back rails 6*a* and 6*b*, such as 1.5 inch diameter stainless steel tubing, which may be a pair of 1.5 inch diameter ADA (Americans with Disabilities Act) compliant grab bars. The back rails 6*a* and 6*b* are secured to a wall 59 (see FIG. 3) adjacent to the shower unit 1. Respective grab bars 61 extend outwardly and forwardly from the back rails 6*a* and 6*b*. The grab bars 61 extend forwardly past the front plate 31 of the base 3 and then curve downwardly and rearwardly to secure to the front plate 31. The backrest 7 is adjustably mounted to the back rails 6*a* and 6*b* on a crossbar 62. Tubular torso supports 63 extend forwardly from the crossbar 62 in position to engage opposed sides of the user's torso should he or she begin to topple sideways. In a shower unit 1 designed for a severely disabled user, a front safety bar (not shown) can be hingedly attached to one of the torso supports 63 and selectively latched to the other torso support 63 in order to keep the user from falling forwardly out of the shower seat 5.

The shampoo array 9 is mounted on the back support 6 and is moveable between working and storage positions. For example, the shampoo array 9 may be rotatably mounted for ninety degree rotation about a vertical axis between a forwardly extending working position and a laterally offset storage position. It is also foreseen that the shampoo array 9 may be selectively vertically moveable along the back rails 6*a* and 6*b* between a raised position and a lowered working position calibrated to the height of the user. The shampoo array 9 is moved by a pneumatic linear or rotary actuator 64 (shown schematically in FIG. 6). The shampoo array includes one or more nozzles 65 connected to the water source 15 and to a source of shampoo 67. The nozzles 65 may also be arranged in an array directed toward the user's head without being mounted in a cap.

Referring again to FIGS. 1-3, a pair of adjustable footrests 68 are mounted on the front plate 31 of the base 3. The footrests 68 are preferably shaped in the form of shallow bowls to serve as individual foot baths. The footrests or foot baths 68 may be connected into the water and soap supply system. As best seen in FIG. 2, the front plate 31 may also have nozzles 69 mounted thereon directed toward the backs of the user's calves.

Additional spray nozzles may be mounted at any convenient location on the apparatus 1 in order to provide full body coverage for the user. For example, nozzles 71 are shown mounted in the seat 5 external from the seat pads 11, nozzles 73 are shown mounted on the grab bars 61, nozzles 75 are shown mounted on the back rails 6*a* and 6*b*, and nozzles 77 are shown mounted on the torso supports 63. The nozzles 77 are directed generally upwardly to clean under the user's arms.

FIG. 6 is a schematic diagram showing pneumatic and plumbing circuits for the shower unit 1. Hot and cold water supplies 15 are connected to a thermal valve 102, such as a Kohler® model K-679-KS thermal valve. Correct temperature water is supplied from the thermal valve 102 to a shower ball valve 105 and a shampoo ball valve 106. The shower ball valve 105 controls flow to the shower nozzles 13, 69, 71, 73, 75 and 77, and to the foot baths 68. The shampoo ball valve 106 controls flow to the shampoo nozzles 65. Thermal detectors 103*a* and 103*b* sense the temperature of the water output from the thermal valve and report to the controller 57, which will not allow the ball valves 105 and 106 to open if the water temperature is outside specified parameters. Similarly, a primary water pressure sensor 104 senses the water pressure and reports to the controller 57.

The ball valve 105 supplies water to a soap mixer 108, which also receives soap from the soap reservoir 16. Soap is moved to the soap mixer 108 from the reservoir 16 by a soap pump 110. Soapy water is then supplied from the soap mixer 108 to the shower nozzles 13, 69, 71, 73, 75 and 77, and to the foot baths 68 through respective supply valves 112-120. Supply valves 112-115 control flow to respective nozzles 13 for each of the seat pads 11*a*-11*d*, which are designated as nozzles 13*a*-13*d*, respectively. Supply valve 116 controls flow to nozzles in the base 3, such as the nozzles 71 in the shower seat 5. Supply valve 117 controls flow to nozzles which spray toward the user from the sides, such as nozzles 73 and 77 in the grab bars 61 and torso supports 63. Supply valve 118 controls flow to nozzles 69 in the front plate 31. Supply valve 119 controls flow to the nozzles 75 on the back support 6. Finally, supply valve 120 controls flow to the foot baths 68.

Similarly, the ball valve 106 supplies water to a shampoo mixer 122, which also receives soap from the shampoo reservoir 67. Shampoo is moved to the shampoo mixer 122 from the reservoir 67 by a shampoo pump 124. The water/shampoo mix is then supplied to the nozzles 65 in the shampoo array 9.

The pneumatic circuit of the shower unit 1 includes the compressor 55, a high pressure air tank 126, and appropriate water separators and filters 127 and 128, respectively. Air pressure is supplied from the air tank 126 to a series of valves 130-164 which are operated by the controller 57. Valve 130 selectively provides air pressure to open and close the shampoo ball valve 106. Valve 132 selectively provides air pressure to open and close the soap ball valve 105. Valve 134 provides air pressure to the shampoo array actuator 64 to rotate (or raise and lower) the shower array 9. Valves 136-142 provide air pressure to open and close valves 112-115, respectively, to operate nozzles 13*a*-13*d* in the seat pads 11*a*-11*d*. Valves 144-152 provide air pressure to open and close valves 116-120, respectively to operate the shower nozzles 69, 71, 73, 75 and 77, and the foot baths 68, as described above. Valves 154 and 156 control the shampoo pump 124 and the soap pump 110, respectively. Valves 158, 160, 162 and 164 are connected to the seat actuators 17 to provide positive pressure to raise the seat pads 11*a*-11*d*, respectively. Valves 158, 160, 162 and 164 are also connected to a vacuum tank 166 which is evacuated by a vacuum pump 168. The valves 158, 160, 162 and 164 can thus also selectively provide vacuum to the actuators 17 to lower the seat pads 11*a*-11*d*, respectively. The air compressor 55, vacuum pump 168, tanks 126 and 166, valves 130-164 and other hardware are generally housed in the interior cavity of the base 3.

The controller 57 is programmed to operate the valves 130-164 using a user interface 170, which may be, for example, a touch screen interface which can be mounted inside or outside of the shower area. Alternatively, the user interface 170 may be voice activated.

Figure 7:
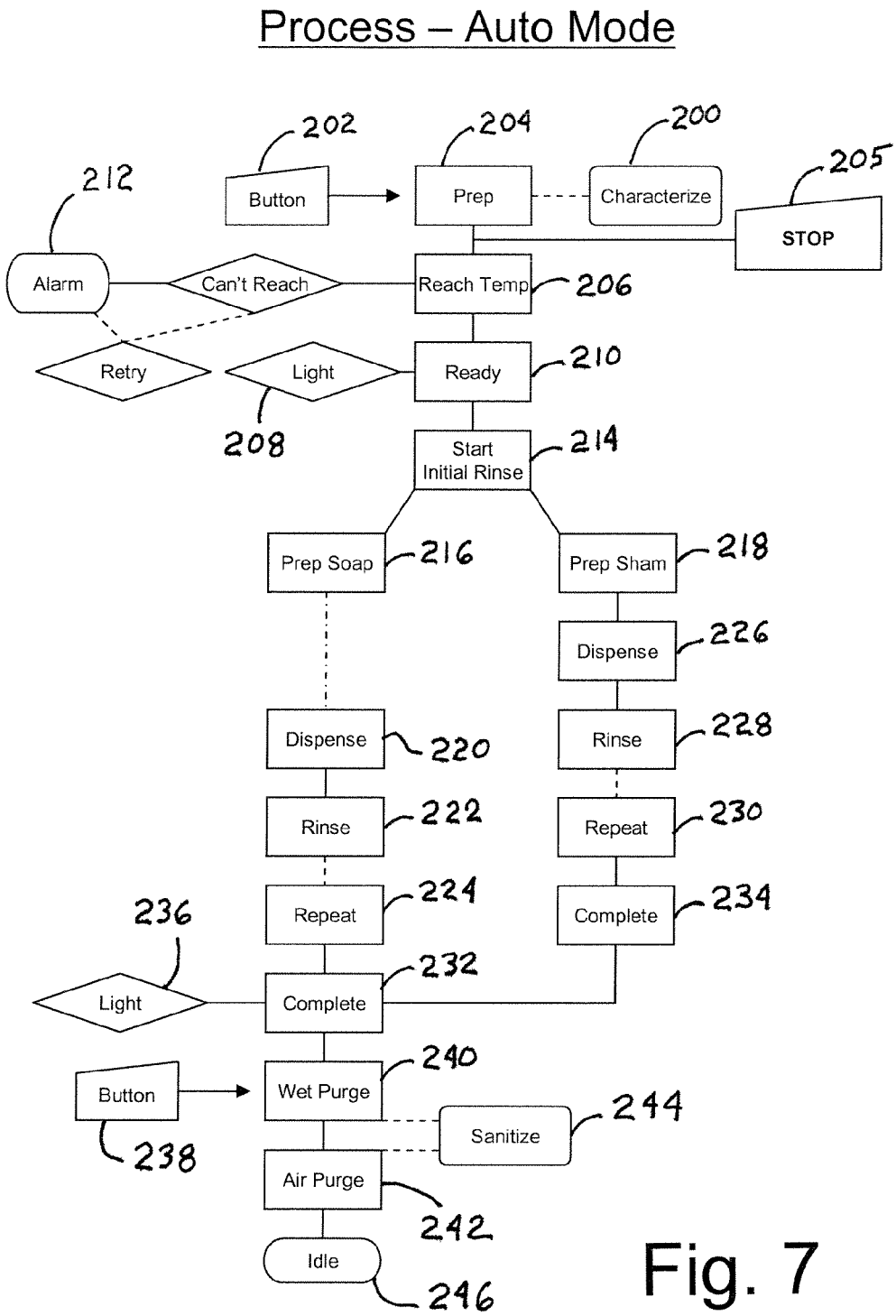
FIG. 7 is a flowchart showing operation of the shower unit under automatic control.
Figure 8:
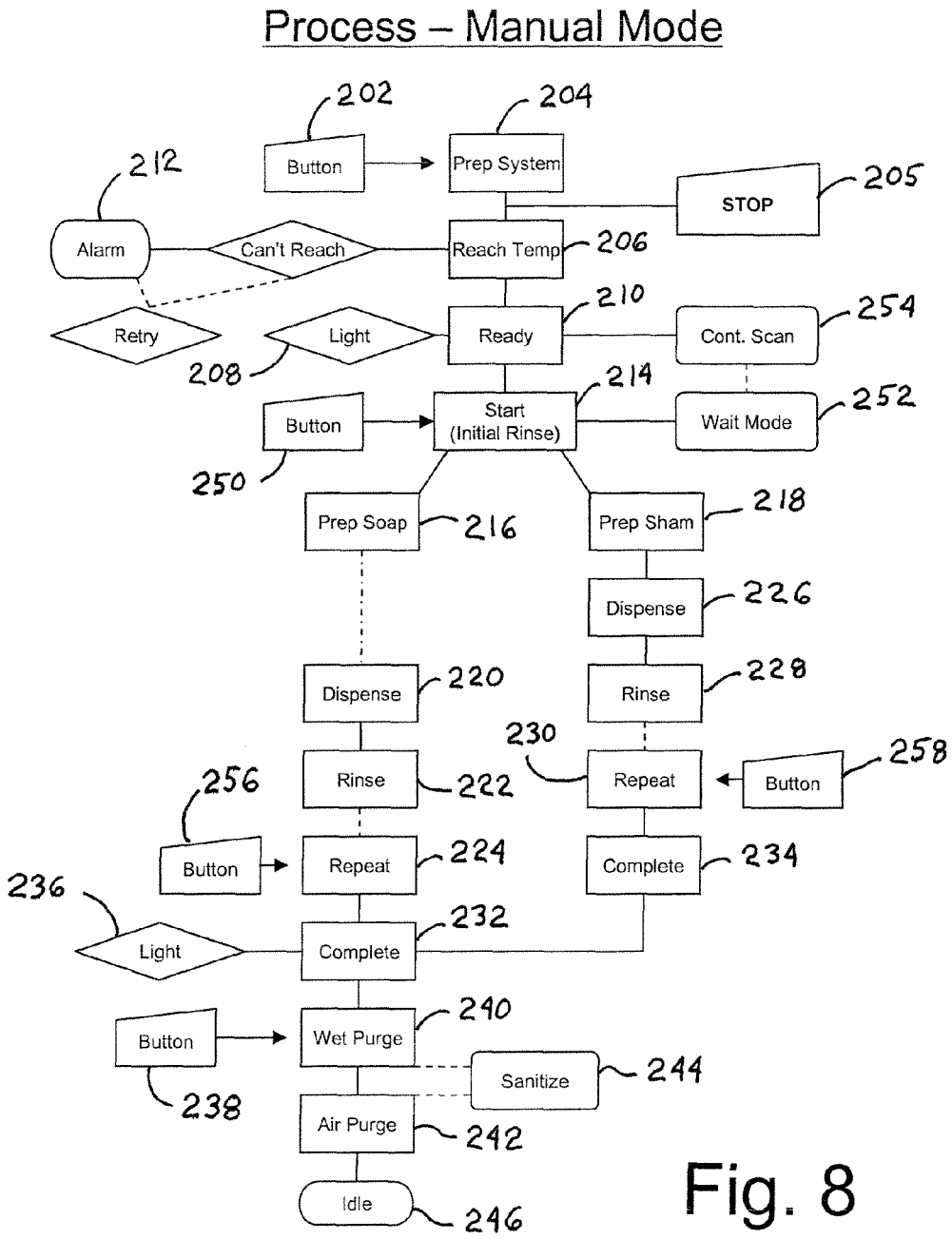
FIG. 8 is a flowchart showing operation of the shower unit under manual control.

In use, the shower unit 1 may be automatically controlled by the controller 57 as shown in FIG. 7 or manually controlled, as shown in FIG. 8. On first setup of the system 1 for automatic control, a characterization step 200 is required to set the run time and number of wash and rinse cycles desired. The characterization step 200 is not repeated on subsequent usages of the shower unit 1 unless it is desired to change the original parameters. The washing process is started by the press of a button 202 on the interface 170, beginning a preparation step 204 where system 1 attempts to achieve the proper operating water temperature (preferably 104 degrees Fahrenheit). An emergency stop button 205 is also provided. If the thermal detectors 103*a* and 103*b* indicate that the correct operating temperature has been reached at reach temperature step 206 a ready light 208 is lit at ready step 210. If the proper temperature is not reached at step 206 then an alarm 212 is activated with an option of retrying.

Once ready step 210 is reached, an initial rinse is started at step 214. After the initial rinse 214, the soap and shampoo are prepared and mixed with water at preparation steps 216 and 218, respectively. Soapy wash water is then dispensed through nozzles 13, 69, 71, 73, 75 and 77, and the foot baths 68 at soap dispensing step 220, followed by a rinse step 222 wherein rinse water is sprayed from the same nozzles. At each of the soap dispensing and rinsing steps 214, 220 and 222 the seat pads 11 will each be retracted to spray from the respective nozzle 13 and then re-extended to support the user while another of the seat pads 11 is retracted. The soap dispensing step 220 and rinse step 222 are repeated at repeat step 224 for the number of cycles set during the characterization step 200.

Shampoo/water mixture is dispensed through the nozzles 65 of the shampoo array 9 at shampoo dispensing step 226 followed by a rinse step 228. The shampoo dispensing step 226 and rinse step 228 are repeated at repeat step 230 for the number of cycles set during the characterization step 200. Once the repeat cycles 224 and 230 are completed at respective complete steps 232 and 234 the cycle stops and a complete light 236 is lit. At this point the user is removed from the shower unit 1.

At the press of a purge button 238, all liquid lines of the shower unit 1 are purged, first with clean water at wet purge step 240 and then with air at air purge step 242. In between the wet purge step 240 and liquid purge step 242, the system can be sanitized with a disinfectant at sanitizing step 244. Once the unit 1 is purged, it goes idle at idle step 246.

FIG. 8 shows the operation of the system 1 under manual control. The process is generally the same as described above except that additional manual controls are added so that the user or another operator can operate certain functions of the shower unit 1 independently of the controller 57 and without relying on pre-programed characterization information. Specifically, a button 250 is provided at the start initial rinse step 214 to manually begin the washing process after the proper operating temperature has been reached. If the button 250 is not activated, the unit 1 goes into a wait mode 252 and the thermal detectors 103*a* and 103*b* continue to monitor the water temperature at step 254 and keep the system 1 ready.

Buttons 256 and 258 are provided at the soap repeat step 224 and the shampoo repeat step 230, respectively. By use of button 256, the operator can manually repeat the soap dispensing step 220 and rinse step 222 as desired. Similarly, by use of button 258, the operator can manually repeat the shampoo dispensing step 226 and rinse step 228 as desired.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements, or to a pair of elements, is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. In a washing apparatus for washing a human user while seated, a seat assembly comprising:

a) a plurality of seat pads, each said seat pad individually moveable between an extended position and a retracted position, in said extended position each of said seat pads supporting the user by contact with a body surface of the user and in said retracted position each of said seat pads exposing the respective body surface;

b) at least one spray nozzle directed to spray past a seat pad in the retracted position for purposes of cleaning the respective body surface; wherein c) when one of said seat pads is in the retracted position at least one of the other seat pads remains in the extended position to support the user.

2. The shower unit as in claim 1 wherein said at least one spray nozzle is mounted in a respective one of said seat pads.

3. The shower unit as in claim 1 wherein said at least one spray nozzle is mounted in said shower seat external of any of said seat pads.

4. The shower unit as in claim 1 wherein there are at least four of said seat pads including two rear seat pads positioned to support respective buttocks of the user and two front seat pads positioned to support respective thighs of the user.

5. The shower unit as in claim 4 wherein said front seat pads are spaced slightly higher than said rear seat pads when all of said seat pads are in the extended positions.

6. The shower unit as in claim 1 wherein said plurality of seat pads are encased by at least one flexible cover.

7. A shower unit comprising:

a) a shower seat upon which a user is seated during a shower, said shower seat including a plurality of seat pads, each said seat pad individually moveable between an extended position and a retracted position, in said extended position each of said seat pads supporting the user by contact with a body surface of the user and in said retracted position each of said seat pads exposing the respective body surface;

b) at least one spray nozzle directed to spray past a seat pad in the retracted position for purposes of cleaning the respective body surface; wherein c) when one of said seat pads is in the retracted position at least one of the other seat pads remains in the extended position to support the user.

8. The shower unit as in claim 7 wherein said at least one spray nozzle is mounted in a respective one of said seat pads.

9. The shower unit as in claim 7 wherein said at least one spray nozzle is mounted in said shower seat external of any of said seat pads.

10. The shower unit as in claim 7 wherein there are at least four of said seat pads including two rear seat pads positioned to support respective buttocks of the user and two front seat pads positioned to support respective thighs of the user.

11. The shower unit as in claim 10 wherein said front seat pads are spaced slightly higher than said rear seat pads when all of said seat pads are in the extended positions.

12. The shower unit as in claim 7 wherein said plurality of seat pads are encased by at least one flexible cover.

13. The shower unit as in claim 7 and further including a back support positioned to support the back of a user seated on said shower seat, said back support having at least one spray nozzle mounted thereon and positioned to spray toward said user.

14. The shower unit as in claim 7 and further including grab bars mounted on opposite sides of said shower seat, each said grab bar having at least one spray nozzle mounted thereon and positioned to spray toward said user.

15. The shower unit as in claim 7 and further including an array of shampoo nozzles mounted above said shower seat and moveable between a storage position and a working position, in said working position said shampoo nozzles being positioned to spray downwardly toward the head of a user seated on said shower seat.

16. The shower unit as in claim 7 and further including a foot bath mounted forward of said shower seat and positioned to receive at least one foot of a user.

17. A shower unit comprising:

a) a shower seat upon which a user is seated during a shower, said shower seat including a plurality of seat pads, each said seat pad individually moveable between an extended position and a retracted position, in said extended position each of said seat pads supporting the user by contact with a body surface of the user and in said retracted position each of said seat pads exposing the respective body surface;

b) at least one respective spray nozzle for each of said seat pads directed to spray past the respective seat pad when said respective seat pad is in the retracted position for purposes of cleaning the respective body surface, said at least one respective nozzle connected to sources of water and soap;

c) a plurality of linear actuators, each said actuator connected to a respective one of said seat pads and operable to move said respective seat pad between said extended and retracted positions; and d) automatic control means for automatically operating said actuators to cyclically move said seat pads and to apply sprays of soap/water mixture and rinse water to the respective body surface through the respective spray nozzles when each said seat pad is in the retracted position.

18. The shower unit as in claim 17 wherein said at least one respective spray nozzle for each of said seat pads is mounted in the respective seat pad.

19. The shower unit as in claim 17 wherein said at least one respective spray nozzle for each of said seat pads is mounted external of the respective seat pad.

* * * * *